US007360735B2

(12) United States Patent
Schneider et al.

(10) Patent No.: US 7,360,735 B2
(45) Date of Patent: Apr. 22, 2008

(54) DEVICE FOR THE ATTACHMENT OF A CARD CLOTHING WITH A FORCE MEASURING DEVICE

(75) Inventors: Hans-Ulrich Schneider, Wildberg (DE); Axel Bauersachs, Althengstett (DE)

(73) Assignee: Hollingsworth GmbH, Neubulach (DE)

( * ) Notice: Subject to any disclaimer, the term of this patent is extended or adjusted under 35 U.S.C. 154(b) by 398 days.

(21) Appl. No.: 10/531,646

(22) PCT Filed: Sep. 11, 2003

(86) PCT No.: PCT/EP03/10128

§ 371 (c)(1),
(2), (4) Date: Apr. 15, 2005

(87) PCT Pub. No.: WO2004/035886

PCT Pub. Date: Apr. 29, 2004

(65) Prior Publication Data

US 2006/0000937 A1 Jan. 5, 2006

(30) Foreign Application Priority Data

Oct. 21, 2002 (DE) ..... 102 49 001

(51) Int. Cl.
*B65H 23/188* (2006.01)

(52) U.S. Cl. ..... 242/419.4; 242/419.5; 242/421.4; 19/114

(58) Field of Classification Search .. 242/419.4–419.5, 242/421.4, 422.2, 412.1, 416, 419.9, 443, 242/447.3; 19/112, 114
See application file for complete search history.

(56) References Cited

U.S. PATENT DOCUMENTS

| | | | | |
|---|---|---|---|---|
| 3,590,537 | A * | 7/1971 | Hennig et al. | 451/254 |
| 3,950,984 | A * | 4/1976 | Russell | 73/774 |
| 4,643,367 | A * | 2/1987 | Waters et al. | 242/447.3 |
| 2004/0056137 | A1 * | 3/2004 | Bocht et al. | 242/416 |

FOREIGN PATENT DOCUMENTS

| | | | | |
|---|---|---|---|---|
| DE | WO 0246505 | A1 * | 6/2002 | 242/416 |
| GB | 435 742 | A | 9/1935 | |

* cited by examiner

*Primary Examiner*—Peter M. Cuomo
*Assistant Examiner*—Sang Kim
(74) *Attorney, Agent, or Firm*—Venable LLP; Catherine M. Voorhees

(57) ABSTRACT

The present invention relates to a device for winding a card clothing onto a roll with a roll drive unit and a braking device acting on the card clothing for generating a winding pretension in a region of the card clothing between roll and braking device. To be able to record the winding operation in an improved way, a force measuring device is provided which is configured to measure the force acting on a mounting point of the braking device, essentially in a direction longitudinal to a winding direction of the card clothing.

22 Claims, 2 Drawing Sheets

DEVICE FOR THE ATTACHMENT OF A CARD CLOTHING WITH A FORCE MEASURING DEVICE

BACKGROUND OF THE INVENTION

The present invention relates to a device for winding a card clothing onto a roll with a roll drive unit and a braking device acting on the card clothing for generating a winding pretension in a region of the card clothing between roll and braking device.

Clothed carding rolls are produced in that a kind of sawtooth wire is wound onto a roll main body. The sawtooth wire lies flat on a feed spool. The device pulls the card clothing off said feed spool. The sawtooth wire is fixed with its free end section onto an outer circumferential piece of the roll main body and passes through a braking device at a distance from the roll main body. The roll main body is driven by a closed-loop controlled drive motor. The braking device consists of brake shoes which laterally press onto the sawtooth wire with spring pressure, so that a certain pretension is always present between the braking device and the roll main body in the card clothing during the winding operation. This device has already been used by the applicant for many years and has proved to be very good. However, attempts are made to achieve an improvement in this respect.

Furthermore, DE 100 61 286 discloses a winding device in which braking rollers are used for permitting controlled braking. Although this device already constitutes a considerable improvement, demands which are particularly made on quality surveillance are to be satisfied in a better way.

BRIEF SUMMARY OF THE INVENTION

It is therefore the object of the present invention to provide a device for winding a card clothing according to the type mentioned at the beginning, which device permits improved surveillance at least of a winding condition.

According to the invention this object is achieved in that a force measuring device is provided which is configured to measure the force acting on a mounting point of the braking device, essentially in a direction longitudinal to a winding direction of the card clothing. Due to the fact that, viewed in the winding direction of the card clothing, the pretension force is applied, force measurement is carried out according to the present invention exactly in this direction or parallel therewith. Therefore, the measured force directly furnishes information on the pretension applied to the card clothing. No conversions are needed as is the case with an indirect determination via power consumption of the motor driving the roll, etc. Force measuring devices are commercially available in many forms, so that these can be used for the most different mounting places. The braking device must be fastened at some place, e.g. on a machine frame. Forces, which in the case of an appropriate construction correspond to the pretension forces, act on the mounting point of the braking device. The forces acting on said mounting point are then measured via the force measuring device. The measured values will then provide very reliable information on the desired pretension with which the card clothing has been wound up. The wording of the claim shall also cover constructions which just measure a force component of the pretension force, but which by reason of the known angular position relative to the winding direction must also be regarded as a direct force-indicating variant. The force should preferably be measured in a vertical plane in which the longitudinal axis of the piece of the card clothing extends in the braking device or substantially in parallel therewith.

In a constructionally very simply configured variant, the braking device is arranged on a slide construction which is movably arranged substantially in a direction longitudinal to the winding direction of the card clothing relative to a stop means, the force measuring device being configured to measure, at least during a winding operation, the support force of the slide construction on the stop means. With such an arrangement the slide construction will try to move by way of the pretension force. This, however, is prevented by the stop construction. The force which is exerted by the slide construction on the stop means will then be measured and will represent a direct measure of the pretension force.

There are many possibilities of designing the slide construction and the stop means. The slide construction could also act against a spring. Preferably, the slide construction should be configured such that apart from the displacement force the number of other forces acting thereon should be as small as possible. If this is not always ensured, this must be counteracted by other measures (e.g. easy running of a slide guide).

The use of a strain-gage force transducer as a force measuring device turns out to be a particularly robust embodiment. This strain-gage force transducer is able to transmit and thereby measure the necessary forces. Moreover, this is a commercially available product that can be kept very easily and at low costs for the intended use.

Preferably, at least part of the force measuring device can be arranged between the slide construction and the stop means. The whole force is then passed through said part of the force measuring device and is available for the measuring operation.

A very smooth running of the slide construction can be achieved according to one variant in that the slide construction comprises at least one ball bushing guided on at least one cylindrical rod. Such ball bushings with accompanying rod guide are standard components which can also be obtained very easily. Moreover, ball bushings can compensate tilt forces to some degree, so that the slide guide need not necessarily extend in one plane with the card clothing. The smooth running of the guide ensures that the force can be measured as much as possible without any additional influencing factors or losses.

According to a further embodiments the braking device may comprise brake shoes which can act on the card clothing and have at least a brake lining of a ceramic material. So far hard-metal brake shoes have been used. The inventor has now found that the use of ceramic materials effects a further improvement in the winding process. It should here be noted that the brake shoes having a lining of ceramic material and acting on a card clothing could also enjoy independent protection without depending on a device for winding a card clothing onto a roll.

Furthermore, a recording device may be provided that at least in portions is configured to record the force curve measured by the force measuring device during the winding operation. It is thereby possible to document the winding operation and to find out whether the necessary pretension was produced during the whole winding operation. This may be a data logger which can be removed after the winding operation and arranged at another place. This makes the device insensitive to the very heavily soiled working environment.

Furthermore, the data logger may be provided with a dynamo which at least during the winding operation is driven by a rotating part of the device and the data logger is configured to be fed with electric current. To avoid electrical connections to a read-out device, which connections are very sensitive, a battery operation of the data logger is of advantage in many cases. However, most of the batteries might not last for the very long winding operations if the battery volume is to be kept within certain limits. An additional support may be provided, for instance in the form of a dynamo. It is also possible to supply power solely via a dynamo, optionally using a capacitor as a buffer storage. For driving the dynamo, there exist several drive possibilities for the dynamo in the winding device. Preferably, the dynamo is driven in direct vicinity of the measured-value acquisition, if possible. Hence, the dynamo could for instance be driven by the guide rolls guiding the card clothing as a part of or near the braking device.

To this end the recording device might be configured to record the winding speed during the winding operation. The winding speed is a further process parameter which plays a decisive role with respect to the quality of the wound card clothing. Moreover, it is possible to sense the temperature in the braking region through a temperature sensor and to integrate these data as well.

If according to a variant the braking device comprises an open and/or closed-loop control unit by which the braking action can be adapted automatically to the winding pretension, the sensed data can be used for the open and/or closed-loop control of the braking device. As a result, the braking action can always be adapted to the optimum operation conditions and a good winding result can be achieved.

Moreover, the roll drive unit can be incorporated into the open and/or closed-loop control circuit of the open and/or closed-loop control unit and the roll drive unit can be controlled during automatic adaptation to the predetermined winding pretension.

The integration of operative states of the roll drive unit, particularly the winding speed in the open or closed-loop control, constitutes an improvement of quality assurance. It should here be mentioned that the temperature of the card clothing in the braking region could be included in the open and/or closed-loop control.

BRIEF DESCRIPTION OF THE SEVERAL VIEWS OF THE DRAWING

In the following an embodiment of the present invention will be explained in more detail with reference to a drawing, in which.

DESCRIPTION OF THE INVENTION

Figure 1:
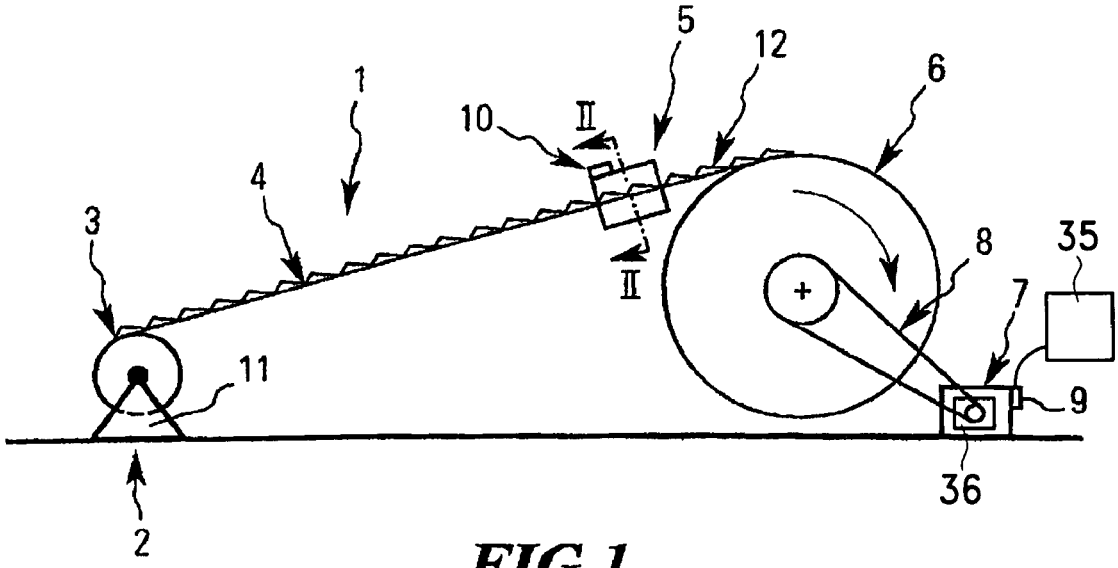
FIG. 1 shows a schematic representation of a winding device in a side view.

The winding device 1 illustrated in FIG. 1 includes primarily a holding station 2 for a feed spool 3 on which a sawtooth wire-shaped card clothing is wound flat, a brake and guide device 5, and a roll 6. The roll 6 is driven by a motor 7 and a transmission device 8 in clockwise direction. The motor 7 has an open and closed-loop control device 9 through which the speed of the roll 6 and the direction of rotation can be controlled. The brake and guide device 5 includes an open and closed-loop control device 10 which ensures a certain braking action. The open and closed-loop control device 9 and the open and closed-loop control device 10 interact with one another. In another embodiment these can be used as a unit for controlling both the brake and guide device 5 and the motor 7.

The sawtooth wire-shaped card clothing 4 is wound off from the feed spool 3 arranged on a pedestal 11, it is then passed through the brake and guide device 5 and wound onto the outer circumference of the roll 6. After the winding process the card clothing 4 will then run in a screw shape on the outer circumference of the roll 6.

The brake and guide device 5 is illustrated in FIG. 1 just schematically as a box. This will be explained in greater detail with reference to FIGS. 2 and 3.

In cooperation with the roll 6, and here in particular via the roll drive, motor 7, the brake and guide device 5 shall apply a pretension in the region 12 of the card clothing 4. This pretension ensures an even and lasting winding of the card clothing 4.

Figure 2:
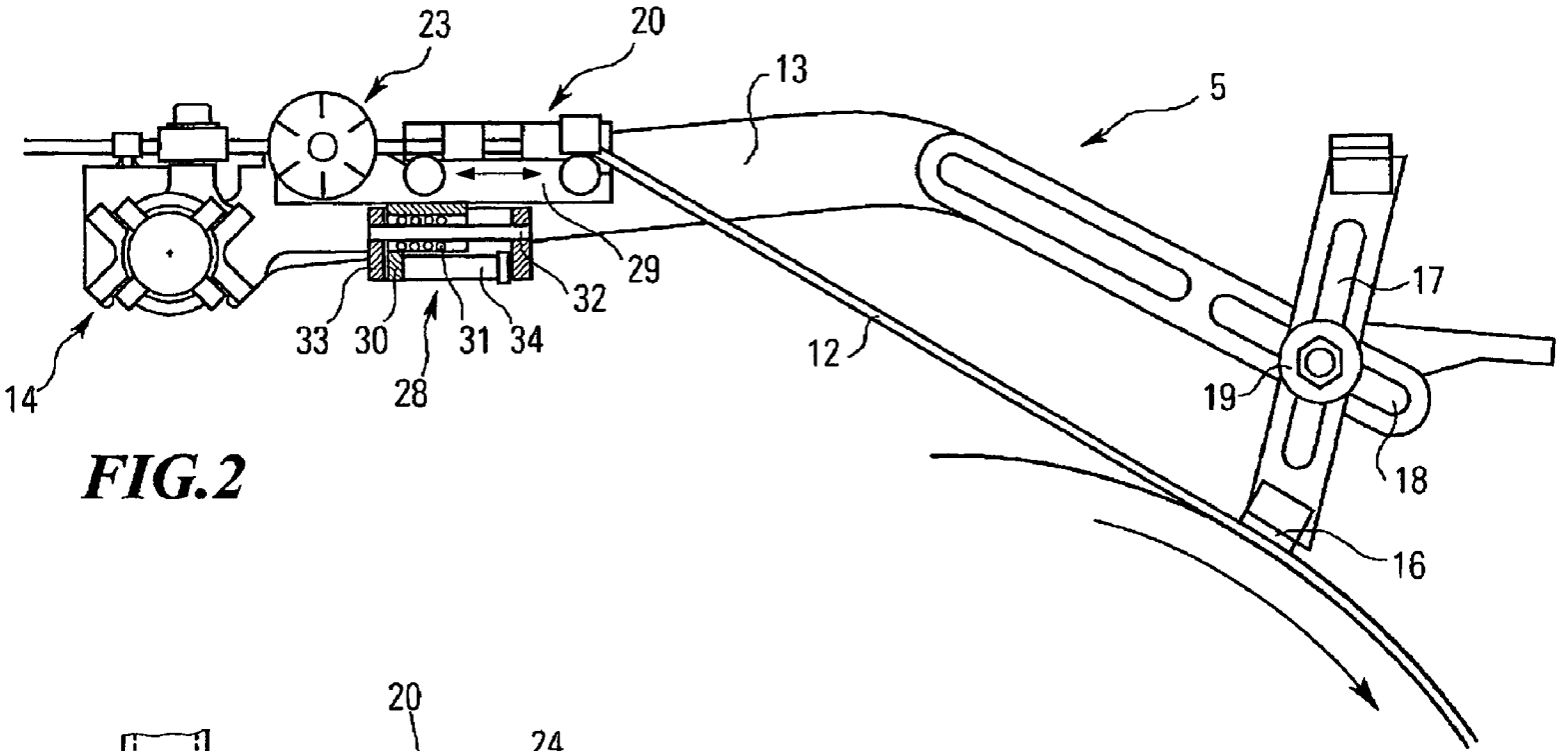
FIG. 2 shows a brake and guide device as is used in a winding device according to FIG. 1.
Figure 3:
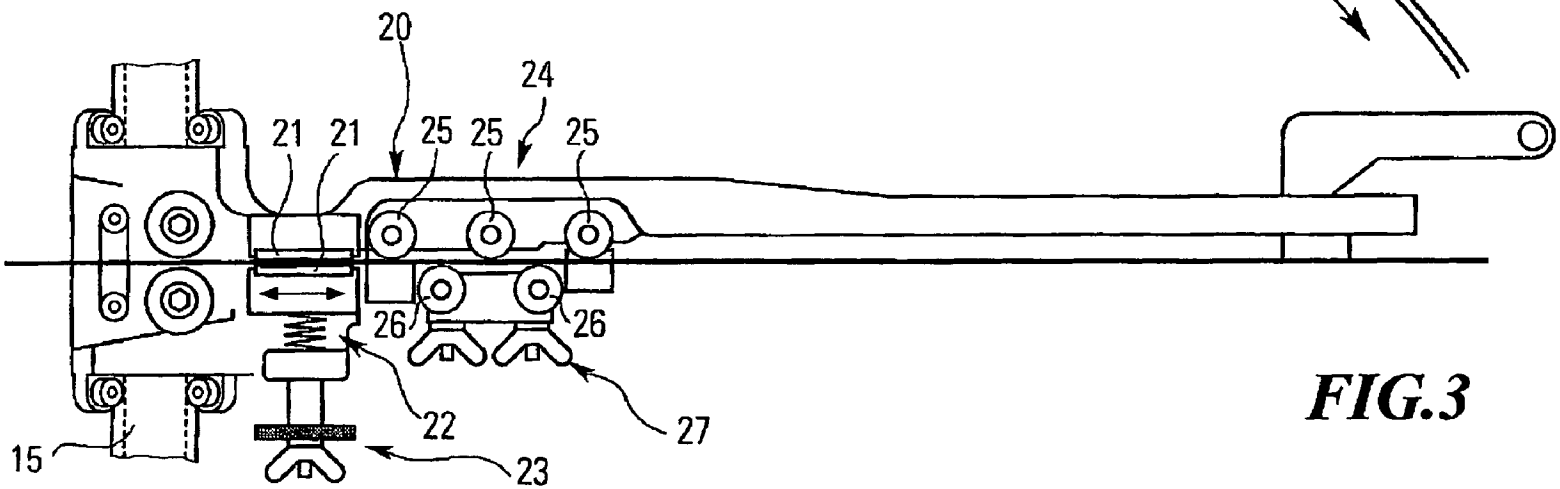
FIG. 3 shows a schematic top view of the brake and guide device of FIG. 2.

The brake and guide device 5 shown in FIGS. 2, 3 comprises a winding arm 13 which at its one end comprises a run guide 14 which is arranged in an axially displaceable manner on a runner tube 15. This enables the winding arm 13 to follow in accordance with the position to be respectively wound up on the roll 6.

At the opposite end, the winding arm 13 comprises a guide finger 16 which ensures an exact placement of the card clothing 4 on the roll. 6. The guide finger 16 itself comprises an elongated hole 17 which, in turn, intersects an elongated hole 18 at the end of the winding arm 13, so that the guide finger 16 can be adjusted through a screw union 19. The brake unit 20 proper is arranged near the runner guide 14. The brake unit 20 has two brake shoes 21 that are displaceable relative to one another, each having a brake lining of a ceramic material. One of the two brake shoes 21 is configured to be adjustable via a spring 22 and an adjusting mechanism 23, whereby the brake force can be adjusted. Downstream of the brake shoes 21, a so-called aligning unit 24 is arranged as part of the brake unit 20. Said aligning unit 24 is provided at one side with three aligning rolls 25 with vertical rotational axes and two opposite contact-pressure rolls 26 having also vertical rotational axes. The contact-pressure rolls 26 are arranged to be movable towards or away from the aligning rolls 25 via the adjusting screws 27. This gives the clothing a desired orientation after having passed through the brake shoes 21.

The whole brake unit 20 is arranged on a slide construction 28. The slide construction 28 comprises a slide 29 which is provided at its bottom side with a ball bushing extension 30. The ball bushing extension 30 has arranged therein a ball bushing 31 which is arranged in an axially displaceable manner on a cylindrical guide rod 32. The slide 29 is displaceable via the ball bushing 31 and the guide rod 32 substantially in parallel with the card clothing guided through the brake unit 20. The guide rod 32 is arranged in a stop construction 33 so that the path of displacement of the slide 29 is limited. A strain-gage force transducer 34 is arranged between the ball bushing extension 30 and a stop surface of the stop construction 33. Said strain-gage force transducer 34 is able to measure the force of displacement of the brake unit 20 with which it is pressed against the stop construction 32. The strain-gage force transducer 34 is firmly connected to the stop construction 33 while its slide is supported on the stop construction. Furthermore, the strain-gage force transducer 34 is coupled with the open and closed-loop control devices 9 and 10, so that there is at least one display that informs the operator whether the desired pretension is observed. In a further configuration, it would also be possible to provide a recording device which documents the force curve accordingly. It is also possible to record the winding speed.

Operation and function of the winding device shall now be explained in more detail in the following. The card clothing 4 is withdrawn from the feed spool and passed through the brake unit 20. The card clothing is here threaded in between the brake shoes 21 and passed through the aligning unit 24. Subsequently, the guide finger 16 is adjusted such that it gets into engagement with the card clothing 4 on the roll 6, i.e. exactly at the point where said clothing impinges on the roll 6. The beginning of the card clothing 4 is then connected to the roll 6, preferably welded or sealed. The brake force is then adjusted via the adjusting mechanism 23. The aligning unit 24 is brought into the correct position via the adjusting screws.

When the device is now set in motion by driving the roll 6 via motor 7, the card clothing 4 will slide through the correspondingly set brake shoes 21. Since this is done with friction, a force by which the slide construction 28 is to be displaced is exerted on the slide construction 28. However, the slide is immediately stopped by the stop construction 33 with the strain-gage force transducer being interposed. The force is measured and represents a direct measure of the pretension force in section 12 of the card clothing 4. It could now be indicated with the help of a simple display whether the pretension force is within the correct range of values. If this is not the case, the brake force must be released or increased via the adjusting mechanism 23.

The brake shoes 21 could also be adjusted automatically. The adjustment of the brake shoes 21 could here be integrated into a control loop. Part of said control loop could also be a temperature sensor which measures the temperature of the card clothing in the area of the brake shoes 21. This sensor will monitor whether the card clothing has heated up in an inadmissible manner.

A winding protocol could be drawn up for each winding operation when a recording device is used, and it could be seen later whether the winding operation took place in a proper way.

According to a further embodiments, a data logger 35 may also be provided as a recording means and integrated into the brake and guide device 5. This data logger 35 records, for instance, the force curve during the winding operation and can be removed after the winding process and read out at another place. Preferably, the data logger 35 may have a battery operation for this purpose. In support thereof, it is also possible in another variant that power is supplied via a dynamo 36, which may also be part of the brake and guide device 5. The dynamo could e.g. be driven via the aligning rolls 25 and the contact-pressure rolls 26. However, other, preferably rotating, parts of the winding device, especially of the brake and guide device 5, are also suited therefor. Complete power supply could also be ensured through a dynamo without a battery operation of the data logger. It would also be possible to interpose a storage capacitor.

The invention claimed is:

1. A device for winding a card clothing (4) onto a roll (6) with a roll drive unit (7) and a braking device (5) acting on the card clothing (4) for generating a winding pretension in a region (12) of the card clothing (4) between the roll (6) and the braking device (5), a force measuring device (34) being provided which is configured to measure the force acting on a mounting point of the braking device (5), characterized in that the braking device (5) is positioned on a slide, the slide together with the braking device (5) is movably arranged substantially in a direction longitudinal to the winding direction of the card clothing (4) and against the force measuring device (34), the force measuring device (34) is supported on a stop means (33), and the force measuring device (34) is positioned between the slide and the stop means (33) so that the slide rests on the force measuring device (34) and the stop means (33) during the winding operation, the force measuring device (34) being configured to directly measure, at least in a winding operation, the support force of the slide on the stop means.

2. The device according to claim 1, characterized in that the force measuring device comprises a strain-gage force transducer.

3. The device according to claim 2, characterized in that the slide comprises at least one ball bushing (31) guided on at least one cylindrical rod (32).

4. The device according to claim 2, characterized in that the braking device (5) comprises brake shoes (21) acting on the card clothing (4), which comprise at least one brake lining of a ceramic material.

5. The device according to claim 2, characterized in that a recording device is provided which at least in portions is configured to record the force curve measured by the force measuring device during the winding operation.

6. The device according to claim 1, characterized in that the slide comprises at least one ball bushing (31) guided on at least one cylindrical rod (32).

7. The device according to claim 6, characterized in that the braking device (5) comprises brake shoes (21) acting on the card clothing (4), which comprise at least one brake lining of a ceramic material.

8. The device according to claim 6, characterized in that a recording device is provided which at least in portions is configured to record the force curve measured by the force measuring device during the winding operation.

9. The device according to claim 1, characterized in that the braking device (5) comprises brake shoes (21) acting on the card clothing (4), which comprise at least one brake lining of a ceramic material.

10. The device according to claim 9, characterized in that a recording device is provided which at least in portions is configured to record the force curve measured by the force measuring device during the winding operation.

11. The device according to claim 1, characterized in that a recording device is provided which at least in portions is configured to record the force curve measured by the force measuring device during the winding operation.

12. The device according to claim 11, characterized in that the recording device is configured as a data logger which in being detachably mounted is configured to be read out at another place.

13. The device according to claim 12, characterized in that the recording device is configured to record the winding speed during the winding operation.

14. The device according to claim 13, characterized in that the data logger is connected to a dynamo which at least during the winding operation is driven by a rotating part of the device and the data logger is configured to be fed with electric current.

15. The device according to claim 12, characterized in that the data logger is connected to a dynamo which at least during the winding operation is driven by a rotating part of the device and the data logger is configured to be fed with electric current.

16. The device according to claim 1, characterized in that the braking device (5) comprises an open loop control unit by which the braking action can be adapted automatically to the winding pretension.

17. The device according to claim 16, characterized in that the roll drive unit (7) is integrated into the open loop of the open loop control unit, and the roll drive unit (7) can be controlled automatically for adaptation to the predetermined winding pretension.

18. The device according to claim 17, characterized in that the data logger is connected to a dynamo which at least during the winding operation is driven by a rotating part of the device and the data logger is configured to be fed with electric current.

19. The device according to claim 1, characterized in that the braking device (5) comprises a closed-loop control unit by which the braking action can be adapted automatically to the winding pretension.

20. The device according to claim 19, characterized in that the roll drive unit (7) is integrated into the closed loop of the closed loop control unit, and the roll drive unit (7) can be controlled automatically for adaptation to the predetermined winding pretension.

21. The device according to claim 1, wherein the braking device presses laterally onto the card clothing.

22. A device for winding a card clothing (4) onto a roll (6) with a roll drive unit (7) and a braking device (5) acting on the card clothing (4) for generating a winding pretension in a region (12) of the card clothing (4) between the roll (6) and the braking device (5), a force measuring device (34) being provided which is configured to measure the force acting on a mounting point of the braking device (5), wherein the slide comprises at least one ball bushing (31) guided on at least one cylindrical rod (32), and the braking device (5) is positioned on a slide, the slide together with the braking device (5) is movably arranged substantially in a direction longitudinal to the winding direction of the card clothing (4) and against the force measuring device (34), the force measuring device (34) is supported on a stop means (33), and the force measuring device (34) is positioned between the slide and the stop means (33) so that the slide rests on the force measuring device (34) and the stop means (33) during the winding operation, the force measuring device (34) being configured to directly measure, at least in a winding operation, the support force of the slide on the stop means.

* * * * *